United States Patent [19]

Weinar

[11] Patent Number: 4,663,906

[45] Date of Patent: May 12, 1987

[54] REMOVABLE CONCEALING WALL TRIM

[76] Inventor: Roger N. Weinar, 164 Buffalo St., Hamburg, N.Y. 14075

[21] Appl. No.: 751,855

[22] Filed: Jul. 5, 1985

[51] Int. Cl.[4] ..... E06B 1/04

[52] U.S. Cl. ..... 52/211; 52/288; 52/717.1

[58] Field of Search ..... 52/211, 212, 718, 254, 52/287, 288, 717

[56] References Cited

U.S. PATENT DOCUMENTS

| | | | |
|---|---|---|---|
| 3,075,235 | 1/1963 | Albinson | 52/211 X |
| 3,534,516 | 10/1970 | Cooper | 52/718 X |
| 3,609,928 | 10/1971 | Mork | 52/718 X |
| 3,956,861 | 5/1976 | Rasmussen | 52/287 |
| 4,014,146 | 3/1977 | DiMascio et al. | 52/211 |
| 4,165,577 | 8/1979 | Shanahan et al. | 52/287 X |
| 4,214,414 | 7/1980 | Wendt | 52/288 |

*Primary Examiner*—Carl D. Friedman
*Attorney, Agent, or Firm*—Eric P. Schellin

[57] ABSTRACT

The present invention is directed to a trim system comprising an E-shaped attaching element and a C-shaped trim member. The E-shaped attaching element is provided with three legs, the first leg having a groove and the second and third legs defining a channel. The C-shaped trim member is provided with a concealing web having two extending portions. The first extending portion is provided with an inwardly projecting rim that engages the groove on the first leg of the attaching element. The second extending portion mates with the channel formed by the second and third legs of the attaching element locking the trim member in place on the attaching element.

9 Claims, 12 Drawing Figures

REMOVABLE CONCEALING WALL TRIM

BACKGROUND OF THE INVENTION

1. Field of the Invention

The present invention is directed to decorative trim used in covering and disguising unfinished and field cut joints of fabricated wall constructions.

2. Description of the Prior Art

It is a common practice today, particularly in commercial buildings, to construct walls and partitions that may be conveniently dismantled with minimal disturbance of occupant activity. It is desirable that the demountable walls have durable, protective trim that can be inconspicuously attached and readily removed to access structural components and fasteners.

Presently one form of trim that has been used comprises two interlocking C-shaped channel runners. A C-shaped retainer channel is attached to the wall and a second, slightly larger decorative C-shaped channel snaps over it. This trim has the appearance of a monolithic trim but the exposed channel is easily dislodged when impacted in normal use. This trim also requires two separate channels for each trim configuration and interchangeable parts are seldom possible. Strict dimensional tolerances must also be maintained with this type of trim since the entire width of both parts is critical to proper mating. Therefore temperature changes can adversely affect the fit of the channels.

Another trim configuration presently in use, uses a runner similar to common top edging, comprising a rigid member with a fastener recess in the center. An accentuated flexible insert is used to cover the fastener recess. The disimilar materials (rigid runner and flexible insert) are required to control the close fit of the two exposed joints, therefore a smooth monolithic surface is seldom achieved.

A remountable unitary wall base trim has been proposed in U.S. Pat. No. 4,214,414, which comprises an extruded plastic member comprising both the attaching element and the trim member. The trim member is coupled to the attaching element by a V-shaped notch so that after the unit has been fastened to the wall, the trim member maybe folded over the attaching element covering the fasteners. The attaching element is provided with a raised node on which the trim member is secured. When the plastic is folded over, stress marks may appear on the trim member. Such marks are especially noticable in darker plastics. In addition, it is difficult to reuse the trim of this configuration because the V-shaped notch will tend to fracture when used a plurality of times. U.S. Pat. Nos. 3,956,861, and 4,014,146, disclose other trim configurations.

It is the object of the present invention to provide a separable wall trim system that is directly attached to the wall structure with ordinary fasteners which are concealed, inconspicuously for a monolithic appearance.

It is also an object of this invention to provide a trim system wherein the trim elements will share interchangeable parts.

It is another object of this invention that the attaching elements of the present trim system be provided with means so that they can be attached to substructure components such as wall caps, and door and window jambs. In additional, the attaching elements maybe provided with hanger clips for hanging wall decorations and pictures without damaging the wall surfaces.

It is a comcomitant object of this invention to provide a wall trim system that maybe readily attached with hand or power driven fasteners and separated for reuse without damaging the components.

SUMMARY

All of the above discussed objects are attained by the present invention which also overcomes the limitations of the previously known trim systems.

The present trim system comprises two basic components, first, an attaching element that is directly fastened to a wall by conventional fasteners, and second, a trim member that conceals that fasteners holding the attaching element to the wall. The attaching element comprises an E-shaped element having three extending legs. A first leg defines the end of the element and is provided with a groove that forms a securing means for holding the trim member. The attaching element further comprises second and third extending legs that together define a channel that forms a locking means for holding the trim member in place. The trim member comprises a C-shaped member having a concealing web and two extending portions. The first extending portion is provided with an inwardly projecting rim forming a gripping means that engages the groove of the first extending leg. The second extending portion is provided with a locking protuberance that is locked in the channel formed by the second and third extending legs.

The second extending leg of the attaching element is also provided with a planar extension that is parallel to the planar base portion. The planar extension maybe formed into a number of configurations for concealing joints in a partition wall system. Furthermore two attaching elements maybe combined to form a corner trim member by joining their planar extensions in a perpendicular fashion.

A portion of the base planar portion of the attaching element located between the first and third extending legs defines a concealed fastener well wherein the fasteners are attached, which mount the attaching means to the wall. This base planar portion is provided with a centering groove for centering the fasteners in the this portion.

DETAILED DESCRIPTION

Figure 1:
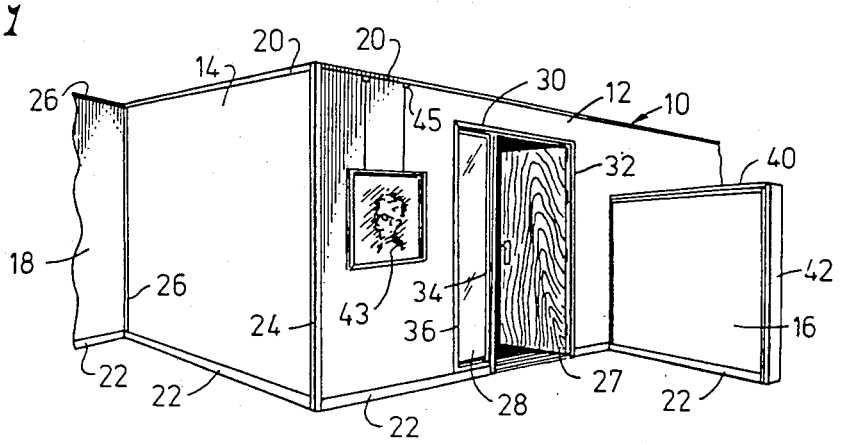
FIG. 1 is a perspective view of a partition construction containing typical wall conditions treated with the present trim system.

FIG. 1 illustrates a typical wall and partition construction 10 having intersecting, ceiling height walls 12 and 14, intermediate height screen walls 16, and foreign or perimeter wall fragment 18. Walls 12 and 14 are trimmed with ceiling/casing wall runner 20, base or floor runner 22, and outside corner runner 24. Wall 14 is trimmed with batten runner 26 at the intersection of the perimeter wall 18. Door 27 and side window 28 are installed in frame 30 built with door jamb 32, mullion 34, and window jamb 36. Screen wall 16 includes floor trim 22, and top and end frames 40 and 42, respectively. Perimeter wall 18 has floor trim 22 and batten trim 26 along the ceiling line. Wall decoration 43 is suspended from hanger clips 45 attached to ceiling/casing runner 20.

Figure 2:
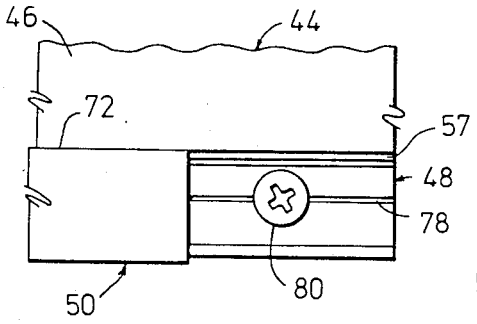
FIG. 2 is a fragmentary front view of a typical attaching element and trim member arranged to expose a typical screw fastener used to mount the attaching member to a wall.
Figure 3:
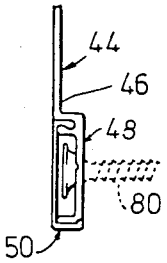
FIG. 3 is a fragmentary side view of the trim runner shown in FIG. 2.
Figure 4:
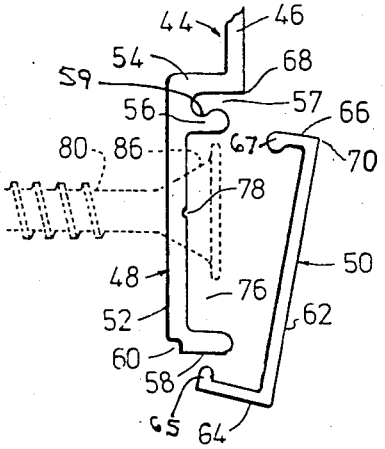
FIG. 4 is an enlarged fragmentary side view of a typical disassembled attaching element and trim member.

FIGS. 2–4 illustrate a typical trim runner fragment 44 (which could be a floor, ceiling, batten or similar runner). Runner 44 comprises two major elements, E-shaped attaching element 48 and C-shaped trim member 50. The E-shaped attaching element is provided with base planar portion 52 from which extends three perpendicular legs, first leg 58, second leg 54 and third intermediate leg 56. The second leg is provided with planar extension 46 that is parallel to the base planar portion of element 49. First leg 58 is provided with groove 60 forming a securing means for the trim member. Second and third legs 54 and 56, respectively, from channel 57 that comprises a locking means for holding the trim member. Third leg 56 is provided with receiving indentation 59 that also constitutes part of the locking means.

Trim member 50 comprises concealing web 62 having two extending perpendicular portions 64 and 66. First extending portion 64 is provided with a gripping means that engages groove 60 on the attaching element. The gripping means comprises an inwardly projecting rim 65. Second extending portion 66 mates with channel 57 locking the trim member in place on the attaching element. The second extending portion is provided with locking protuberance 67 that engages receiving indentation 59 on the third extending leg of the attaching element.

When the trim member is snapped in place on the attaching element, corner 70 of the trim member adjoins corner 68 of the attaching member forming an almost invisible joint 72. In that first extending portion 64 of the trim member completely covers that first extending leg of the attaching member only one joint needs to be controlled allowing for greater dimensional tolerances in the manufactured parts. It should also be noted, as illustrated in FIG. 2, that the end of trim member 50 does not coincide with the end of attaching element 48 to minimize the visible distraction of such joints.

The attaching element maybe secured to a wall by any conventional fastening element such as screw 80. The screw is drilled into fastener well 76 defined by the planar based portion and the first and third extending legs. The head of the screw is exposed in fastener well 76 and concealed when trim member 50 is attached. The screw is centered in the well by centering groove 78 that provides a starting indentation for the screw when applied by power screw driver 82 having depth gauge 84. The gauge stops the placement of the screw when it comes into contact with first leg 58 and third leg 56 preventing bugle shoulder 86 of the screw from entering and distorting the base planar portion of the attaching element.

Figure 5:
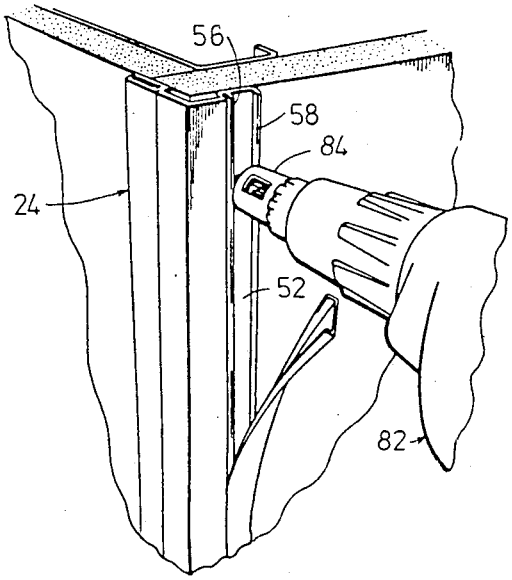
FIG. 5 is a perspective view of a wall fragment illustrating the attachment of outside corner trim with a common power screw driver.
Figure 6:
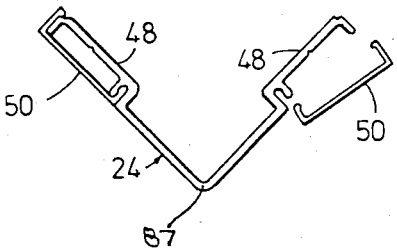
FIG. 6 is an end view of a partially assembled trim system used on an outside corner.

FIG. 5 and 6 illustrate outside corner trim runner 24 formed from two attaching elements having planar extensions that are formed together in a perpendicular fashion at 87.

Figure 7:
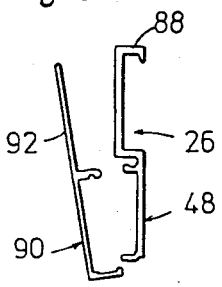
FIG. 7 is an end view of an unassembled trim system for use as a batten strip, illustrating a modified trim member.

FIG. 7 illustrates batten trim runner 26 wherein the planar extension is provided with a perpendicular extension 88. Of particular interest is trim member 90 wherein the concealing web is provided with extending portion 92.

Figure 8:
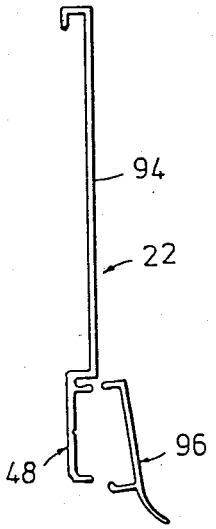
FIG. 8 is an end view of an unassembled trim system designed for use as a floor or base cover having a modified trim member.
Figure 9:
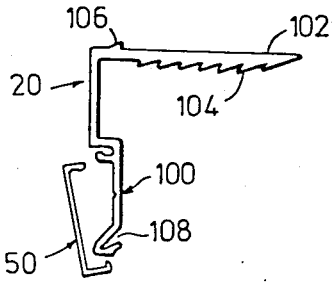
FIG. 9 is an end view of an unassembled trim system designed for use as a ceiling or casing angle.

FIG. 8 illustrates base trim runner 22 wherein the attaching element is provided with elongated planar extension 94. Trim member 96 is provided with an extending portion that is flexible for use with irregular floor surfaces.

Figure 10:
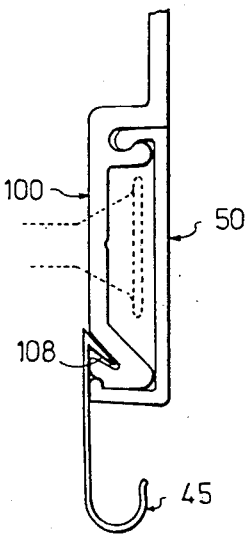
FIG. 10 is an enlarged fragmentary view of an assembled trim system, similar to the trim system illustrated in FIG. 9, having a hanger clip.

FIGS. 9–12 illustrate ceiling trim runner 20 wherein the planar extension of attaching element 100 is provided with perpendicular portion 102 having serrated surface 104 and stop projection 106. The first extending leg of element 100 is provided with notch 108 for holding hanger clip 45, as illustrated in FIG. 10. The hanger clip permits the visible suspension of pictures and decorations without wall surface damage. This is particularly advantageous on walls and partitions constructed with prefinished reusable exposed panels.

Figure 11:
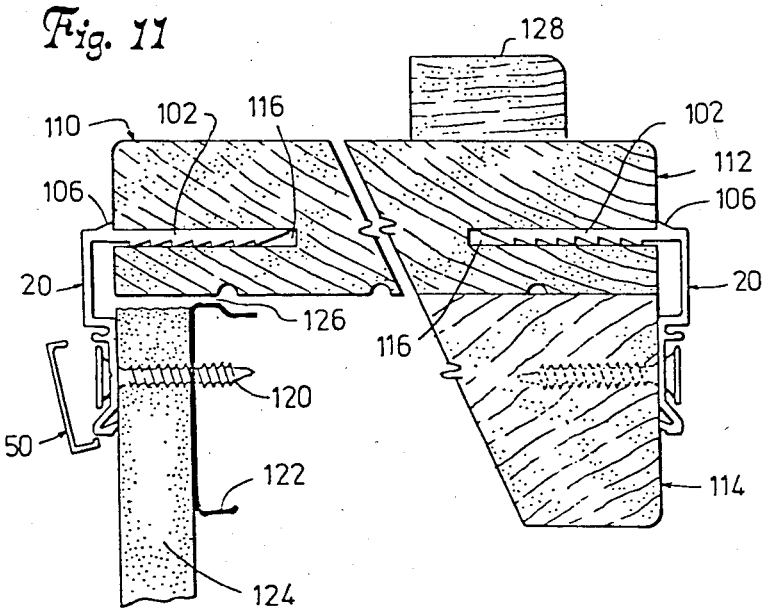
FIG. 11 is a cross sectional view of a wall fragment showing an attaching element that is similar to that illustrated in FIG. 9, which is affixed to wood trim and composite frames.

In FIG. 11 ceiling trim 20 is employed as a structural casing runner which is affixed to slotted terminal frame 110, slotted door frame 112 and solid mullion frame 114. Frames 119 and 112 are rectangular and solid with edge slots 116 and 118 extending longitudinally along opposite narrow sides. Serrated perpendicular portion 102 is driven into slot 116 to a depth determined by stop projection 106, and screw 120 is fastened to metal stud 122 through wall panel 124. Space 126 is formed between frame 110 and stud 122 and permits shock absorbing deflection with trim runner 20 is formed of reilient material. Frame 112 with door stop runner 128 could be directly attached to a wall structure as frame 110 or joined to other frame sections such as composite mullion frame 114, as illustrated in FIG. 11. Although wood frames are illustrated in FIG. 11, frames maybe formed of plastic, metal or fiber form material.

Figure 12:
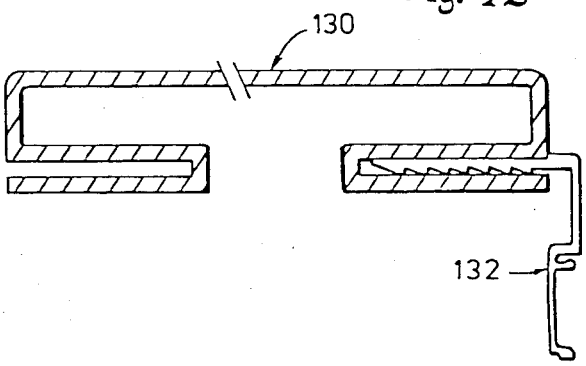
FIG. 12 is a fragmented sectional view of an attaching element similar to that illustrated in FIG. 9, used as affixable casing on a hollow frame member.

FIG. 12 illustrates hollow frame 130 having trim runner 132 secured in a slot.

It is envisioned that the attaching elements and the trim member would be formed of an extruded plastic material. However other materials and processes could be used to make the disclosed trim system.

Although the present invention has been disclosed with regards to specific embodiments, it should not be so limited but should be limited solely by the claims that follow.

I claim:

1. Removable wall trim system for concealing wall joints, said trim system comprising:

an E-shaped attaching element comprising a planar based portion through which fasteners can be passed to attach the element to a wall, the E-shaped attaching element is provided with a first extending leg defining one end of the planar base portion, the first extending leg having a securing means, the E-shaped attaching element is further provided with a second extending leg and a third intermediate extending leg, the third intermediate extending leg is positioned between the first and second extending legs, the second and third extending legs define a locking means, wherein the second extending leg is provided with a planar extension having an external surface than extends parallel to the planar base portion, the external surface of the planar extension and the second extending leg intersect and form a corner; and a C-shaped trim member for covering the attaching element, the C-shaped trim member being provided with a concealing web located between a first extending portion and a second extending portion, and having an external surface, the concealing web conceals the fasteners attaching the planar base portion of the E-shaped attaching element to a wall when the trim member is mounted to the attaching element, the second extending portion engages the locking means on the E-shaped attaching element thereby holding the C-shaped trim member in place on the E-shaped attaching means, the first extending portion is provided with a gripping means for engaging the securing means on the first extending leg of the E-shaped attaching element and further holding the C-shaped trim member in place on the E-shaped attaching element when the trim member is mounted thereon, the external surface of the concealing web portion intersects the second extending portion forming a corner that adjoins the corner formed by the external surface of the attaching means when the trim member is mounted to the attaching element so that the external surfaces of the attaching element and the trim member are located in the same plane and the adjoining corners form a substantially invisible joint between the members giving the trim member and the attaching element a monolithic appearance.

2. A wall trim system as defined by claim 1 wherein the securing means comprises a groove.

3. A wall trim system as defined by claim 2 wherein the locking means comprises a channel formed by the second and third extending legs.

4. A wall trim system as defined by claim 3 wherein the locking means further comprises a receiving indentation on the third extending leg that is adapted to receive a locking protuberance on the second extending portion of the C-shaped trim member.

5. A wall trim system as defined by claim 4 wherein the gripping means on the first extending portion of the C-shaped trim member is a rim that engages the groove of the securing means on the first extending leg.

6. A wall trim system as defined by claim 1 further comprising a second attaching element and a second trim member, wherein the second attaching element is provided with a second planar extension that is joined to the planar extension of the E-shaped attaching element in a perpendicular fashion so as to form a corner trim section.

7. A wall trim system as defined by claim 1 wherein the planar extension is provided with a perpendicular portion having a serrated surface for mounting into a slot wherein the perpendicular portion is also provided with a stop projection that acts as a depth gauge for the perpendicular portion.

8. A wall trim system as defined by claim 1 wherein the planar base portion of the E-shaped attaching means located between the first and third extending legs is provided with a centering groove for centering screws for mounting E-shaped attaching element on a wall.

9. A wall trim system as defined by claim 1 wherein the attaching element and the trim member are formed from extruded plastic.

* * * * *